US009644370B2

(12) United States Patent
Kennelly et al.

(10) Patent No.: US 9,644,370 B2
(45) Date of Patent: May 9, 2017

(54) TRUSSES FOR USE IN BUILDING CONSTRUCTION AND METHODS OF INSTALLING SAME

(71) Applicant: Illinois Tool Works, Inc., Glenview, IL (US)

(72) Inventors: Bernard Joseph Kennelly, North Balgowlah (AU); Michael Timothy Paull, Arlington Heights, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/943,835

(22) Filed: Nov. 17, 2015

(65) Prior Publication Data

US 2016/0145867 A1 May 26, 2016

(30) Foreign Application Priority Data

Nov. 26, 2014 (AU) ..... 2014904787
Jun. 2, 2015 (AU) ..... 2015902094

(51) Int. Cl.
*E04B 1/19* (2006.01)
*E04B 7/06* (2006.01)
(Continued)

(52) U.S. Cl.
CPC ..... *E04B 7/063* (2013.01); *E04B 7/022* (2013.01); *E04C 3/11* (2013.01); *E04C 3/17* (2013.01); *E04C 2003/0495* (2013.01)

(58) Field of Classification Search
CPC ..... E04C 3/02; E04C 3/11; E04C 3/17; E04C 2003/0495; E04B 7/063; E04B 7/022; E04B 1/19; E04B 1/344; E04B 1/3444
See application file for complete search history.

(56) References Cited

U.S. PATENT DOCUMENTS 3,175,650 A * 3/1965 Wohlfort ..... E04B 1/19 52/646
3,375,624 A * 4/1968 Mikulin ..... E04B 1/19 52/109

(Continued)

FOREIGN PATENT DOCUMENTS

BE 1 014 438 10/2003
DE 696 108 9/1940

(Continued)

OTHER PUBLICATIONS

Extended European Search Report for European Application No. 16171136.1, dated Mar. 13, 2017 (16 pages).

*Primary Examiner* — Brian Mattei
*Assistant Examiner* — Gisele Ford
(74) *Attorney, Agent, or Firm* — Neal, Gerber & Eisenberg LLP

(57) ABSTRACT

A truss assembly for use in building construction, comprising a first truss and one or more second trusses attached to the first truss to extend transversely to a face of the first truss upon erection of the truss assembly, wherein the or each second truss is hingedly connected to the first truss for swinging movement about a substantially vertical axis between a folded configuration in which the second truss lies adjacent the face of the first truss and an erected configuration in which the second truss extends transversely to said face.

9 Claims, 9 Drawing Sheets

(51) Int. Cl.

| | |
|---|---|
| ***E04B 7/02*** | (2006.01) |
| ***E04C 3/11*** | (2006.01) |
| ***E04C 3/17*** | (2006.01) |
| *E04C 3/04* | (2006.01) |

(56) References Cited

U.S. PATENT DOCUMENTS 3,435,570 A * 4/1969 Berry ..... E04H 12/185 108/145
3,600,869 A * 8/1971 Petroff ..... E04B 1/19 52/330
3,830,031 A * 8/1974 Soisson ..... E04B 1/19 52/109
4,539,786 A * 9/1985 Nelson ..... B64G 9/00 244/159.5
4,557,083 A * 12/1985 Zanardo ..... B64G 9/00 244/159.5
4,569,176 A * 2/1986 Hedgepeth ..... B64G 9/00 182/152
4,601,152 A * 7/1986 Coppa ..... E04C 3/02 403/187
4,644,628 A * 2/1987 Coppa ..... E04C 3/02 29/429
4,819,399 A * 4/1989 Onoda ..... B64G 9/00 52/645
4,958,474 A * 9/1990 Adams ..... E04H 12/185 52/108
5,040,349 A * 8/1991 Onoda ..... B64G 9/00 52/645
5,050,353 A * 9/1991 Rogers ..... E04H 3/28 52/118
5,094,059 A * 3/1992 Ganescu ..... E04B 1/3441 16/371
5,819,492 A * 10/1998 Konicek ..... E04C 3/005 403/119
5,888,621 A 3/1999 Frohlich et al.
6,634,152 B1 * 10/2003 Pilkinton ..... E04C 3/005 52/641
9,062,448 B2 * 6/2015 Richardson ..... E04B 1/1903
2006/0032178 A1 * 2/2006 Jensen ..... B29C 70/50 52/633
2007/0044415 A1 * 3/2007 Merrifield ..... E04B 1/3441 52/633
2007/0145195 A1 * 6/2007 Thomson ..... B64G 1/222 244/172.6
2007/0151200 A1 * 7/2007 Madray ..... E04C 3/11 52/690
2008/0283670 A1 * 11/2008 Harvey ..... B64G 1/222 244/172.6
2013/0263548 A1 * 10/2013 Merrifield ..... E04C 3/005 52/646
2015/0041252 A1 2/2015 Grumberg et al.
2015/0101261 A1 * 4/2015 Merrifield ..... E04C 3/005 52/67
2016/0090741 A1 * 3/2016 Jobin ..... E04C 3/005 52/646

FOREIGN PATENT DOCUMENTS

| | | |
|---|---|---|
| DE | 26 34 179 | 2/1978 |
| EP | 0 866 186 | 9/1998 |
| EP | 2 113 616 | 11/2009 |
| FR | 1 233 563 | 10/1960 |
| JP | S64 58745 | 3/1989 |
| JP | H04 254645 | 9/1992 |
| JP | 2 847382 | 1/1999 |
| WO | WO 2014/186906 | 11/2014 |

* cited by examiner

TRUSSES FOR USE IN BUILDING CONSTRUCTION AND METHODS OF INSTALLING SAME

PRIORITY CLAIM

This application claims priority to and the benefit of: (1) Australian Patent Application No. 2014904787, filed on Nov. 26, 2014; and (2) Australian Patent Application No. 2015902094, filed on Jun. 2, 2015, the entire contents of each of which are incorporated herein by reference.

BACKGROUND

1. Field

The present disclosure in one aspect relates to trusses in use for building construction, particularly in the construction of roofs. The disclosure in another aspect relates to the installation of a truss within the overall building structure.

2. Description of the Prior Art

In some types of building construction it is conventional practice to construct the roof using trusses prefabricated in a factory situation and transported to site for erection onto wall frames or other wall structure of the building. Although the main structure of a roof will normally be formed by a series of trusses arranged in spaced parallel relation, in the construction of a complex roof such as one having hips and/or gables further trusses are installed to a face of one or more of other trusses within the structure after installation so as to extend transversely from the face of that truss, usually at right angles thereto. Typically those further trusses will also be of prefabricated construction whereby substantially the entire basic roof structure can be assembled on site from prefabricated components. Although construction of a roof from prefabricated trusses removes much of the skill which would otherwise be needed to construct a roof and, of course, enables relatively quick construction, nevertheless installing and fastening supplementary trusses within the main structure by installing to the face of a main truss for instance, can add a degree of complexity. The supplementary trusses require separate handling and need to be accurately located relative to the main truss and then attached using suitable brackets. This has to be done by people working at the height of the roof of course, and does involve a degree of skill. The environment in which the installers are working at roof level is not a stable environment and required "safe work practices" are not always adhered to. Many of those working on site can be at risk until a main truss and its supplementary trusses are installed, temporarily braced, and made stable. Additionally, issues sometimes issues arise through absence of adequate documentation for identification and accurate placement of the supplementary trusses.

SUMMARY

The present disclosure in one aspect seeks to ameliorate the difficulties discussed above.

In the installation of the trusses they need to be anchored to the underlying wall structure of the building, typically by fastening the bottom chord of a truss to the top plate of an underlying wall frame and which itself is usually of prefabricated form. A typical attachment consists of brackets fastened by nails to the top plate and bottom chord, itself quite a time consuming exercise carried out at roof level. The present disclosure according to another aspect provides an attachment system which provides quicker fastening between the truss and top plate or other underlying structure during installation.

According to one aspect of the present disclosure there is provided a truss assembly for use in building construction, comprising a first truss and one or more second trusses attached to the first truss to extend transversely to a face of the first truss upon erection of the truss assembly, wherein the or each second truss is hingedly connected to the first truss for swinging movement about a substantially vertical axis between a folded configuration in which the second truss lies adjacent the face of the first truss and an erected configuration in which the second truss extends transversely to said face.

According to another aspect of the present disclosure there is provided a fastening for coupling two components of a building structure comprising a first part for attachment to one of the components and a second part for attachment to the other of the component, the first and second parts each being of plate-like form, the first part providing a multiplicity of locking projections and the second part providing a multiplicity of apertures arranged in a configuration equivalent to that of the locking projections of the first part such that when the two parts are applied together in face-to-face relation the locking projections of the first part can extend through the apertures of the second part and lock to the second part to thereby lock the two parts together against separation of the two parts.

According to yet another aspect of the present disclosure, there is provided a truss assembly for use in building construction comprising a first truss, a second truss attached to the first truss for swinging movement about a substantially horizontal axis between a folded configuration in which the second truss lies adjacent to a face of the first truss and an erected configuration in which a bottom chord of the second truss is spaced outwardly from the first truss, and linking means pre-assembled to the two trusses and which in the erected configuration form a rigid coupling between the two trusses to form a stable braced structure.

BRIEF DESCRIPTION OF THE DRAWINGS

Embodiments of the present disclosure will now be described by way of example only with reference to the accompanying drawings in which.

DETAILED DESCRIPTION

In an embodiment according to the first aspect of the present disclosure, prefabricated trusses which, in the assembled roof structure are to be attached to and extend transversely from another prefabricated truss, usually one of the larger trusses and which will be referred to for simplicity as a "main" truss are assembled to the main truss by hinges as part of the pre-fabrication process. The hinges provide a secure connection between the main truss and the other trusses, referred to for simplicity as "supplementary trusses", and permit the supplementary trusses to be swung from a position in which a face of the supplementary truss lies adjacent a face of the main truss for transportation to site on the bed of a truck and lifting into position on site, typically by means of a crane. When the main truss is in position on the top plate or other underlying structure, the supplementary trusses can then be swung outwardly from the face of the main truss into its required orientation transversely to the main truss. Depending on the design of the roof structure, that orientation can be at 90° to the main truss or at an acute angle.

Figure 1:
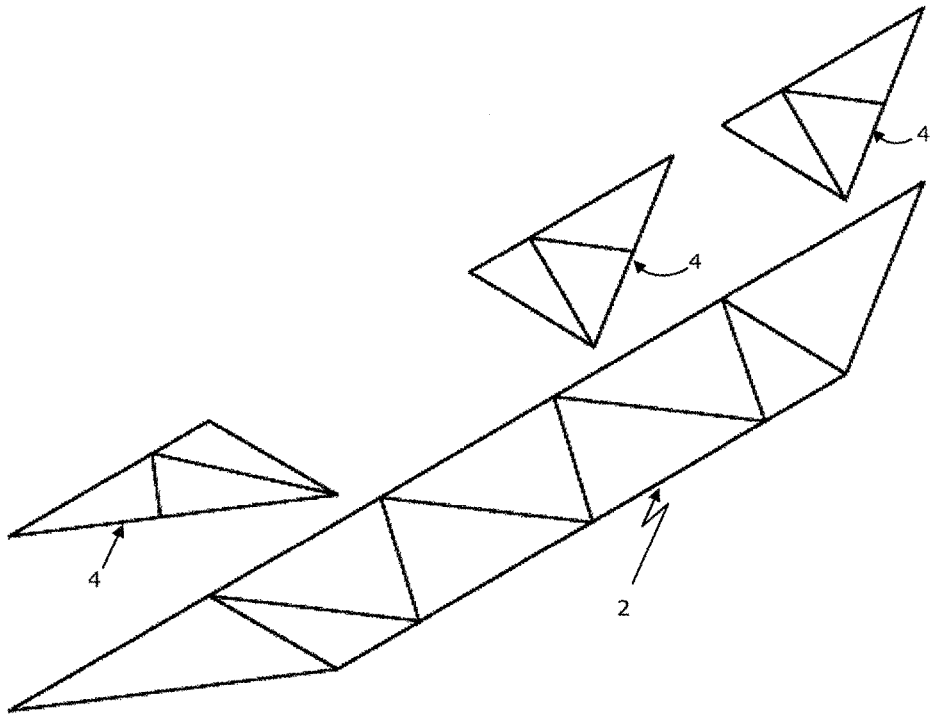
FIG. 1 shows in exploded form components of a truss assembly according to one aspect of the present disclosure.
Figure 2:
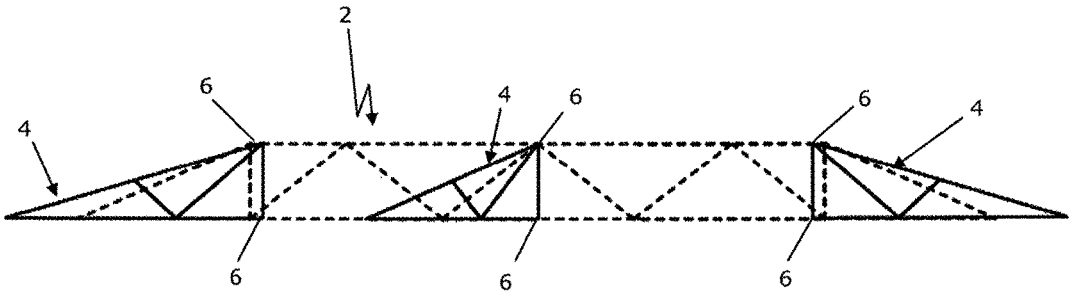
FIG. 2 shows the truss assembly in its assembled configuration with supplementary trusses hingedly attached to a main truss and the supplementary trusses in a folded configuration against the main truss.

FIG. 1 shows by way of example a main truss 2 and a set of three supplementary trusses 4 prior to assembly together by hinges as discussed above. In the assembled roof, the supplementary trusses are intended to form a hip end of the roof. FIG. 2 shows the supplementary trusses 4 attached to the main truss 2 by the hinges and folded to lie with their faces against the adjacent face of the main truss for transportation to site and for lifting into position. In the particular design shown, each supplementary truss 4 is hinged to the top chord and bottom chord of the main truss 2 at hinge points 6, the hinge axis of each supplementary truss 4 being vertical considered in relation to the main truss when lying in a vertical plane in its installed condition. Although in the embodiment shown the supplementary trusses are hinged to the top and bottom chords of the main truss by respective upper and lower hinges, other placements of the hinges would be possible with different designs of main and supplementary trusses. However it is envisaged that in most circumstances there would be at least an upper and lower hinge for each supplementary truss although it is conceivable that a single longer hinge might suffice in some circumstances. The hinges are fixed to the trusses by any suitable means such as screwing, nailing, or gluing, or by nail-plates. The primary function of the hinged connection between the supplementary truss and main truss is to enable the supplementary truss to be swung out from its folded condition assumed during transportation and lifting and, as such, the hinges only need to have capacities to withstand the handling and installation loads. Although in principle they could also be designed to withstand in-service loading in the completed roof structure, in practice it is envisaged supplementary fixings would be subsequently installed to withstand the in-service loading, these supplementary fixings being fitted later in the installation process when the majority of the roof structure is in place and braced to provide a stable and safe working environment.

In the example shown, each of the supplementary trusses is of a length which enables the set of supplementary trusses to be folded flat against the face of the main truss and which is desirable as it enables a series of such truss assemblies to be stacked flat for transportation. Nevertheless the overall concept would still be applicable for use with somewhat longer supplementary trusses in which, in their folded condition for transportation, an outer end of one supplementary truss might overlap the inner end of the adjacent supplementary truss whereby in its folded state it is inclined to the adjacent face of the main truss rather than lying flat against it.

Figure 3:
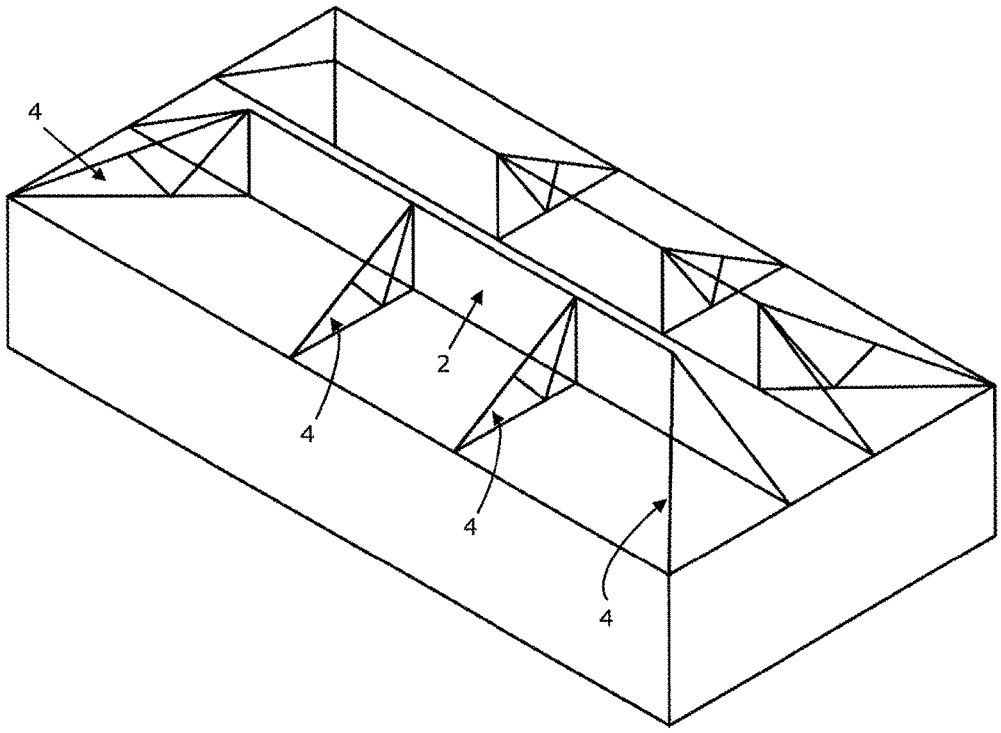
FIG. 3 shows schematically a typical roof structure as could be formed from truss assemblies according to the present disclosure.
Figure 4:
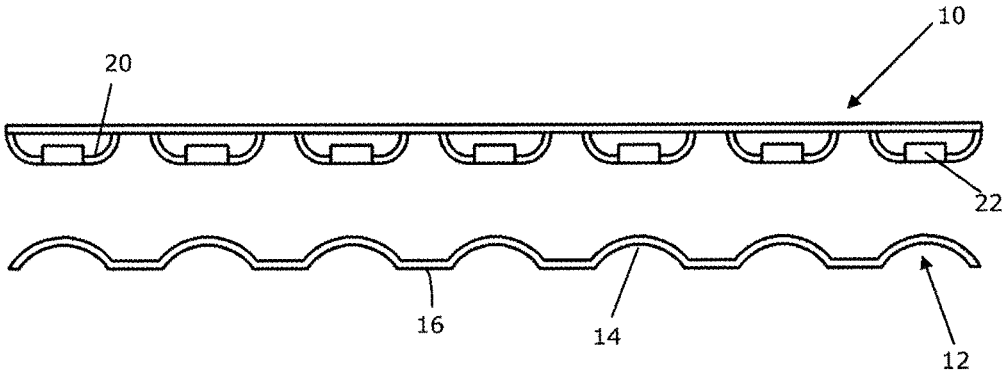
FIG. 4 is a side view showing respective parts of a quick-action fastening in accordance with another aspect of the present disclosure, the parts being shown prior to coupling of the two parts.
Figure 5:
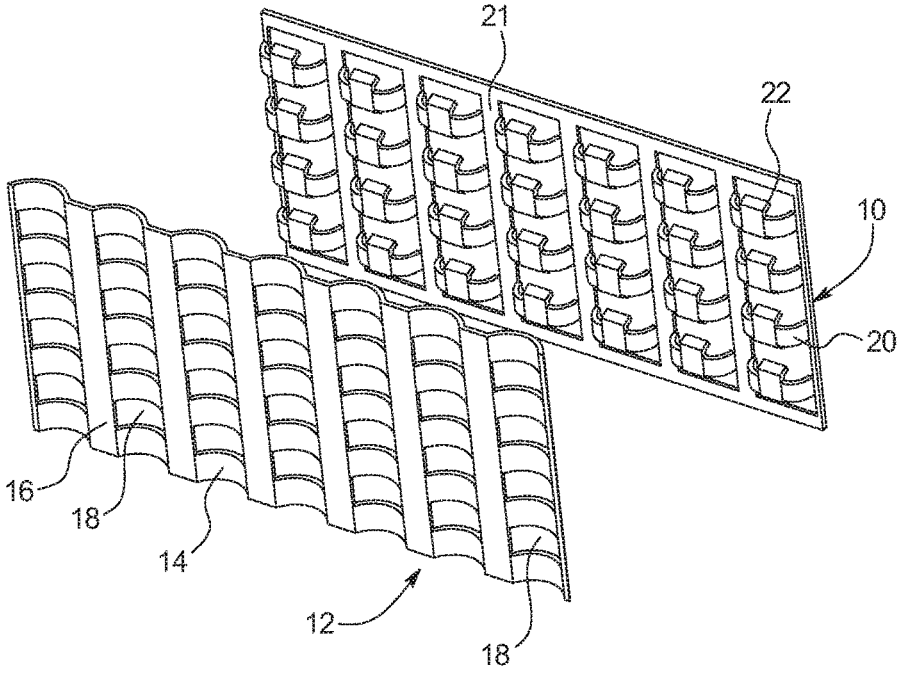
FIG. 5 is a perspective view equivalent to FIG. 4.
Figure 6:
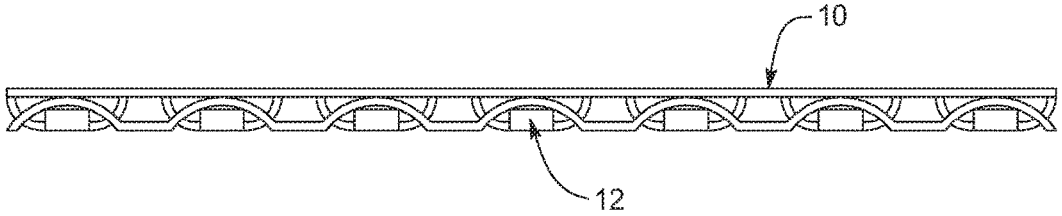
FIG. 6 is a side view similar to FIG. 4 but showing the two parts in their coupled relation.
Figure 7:
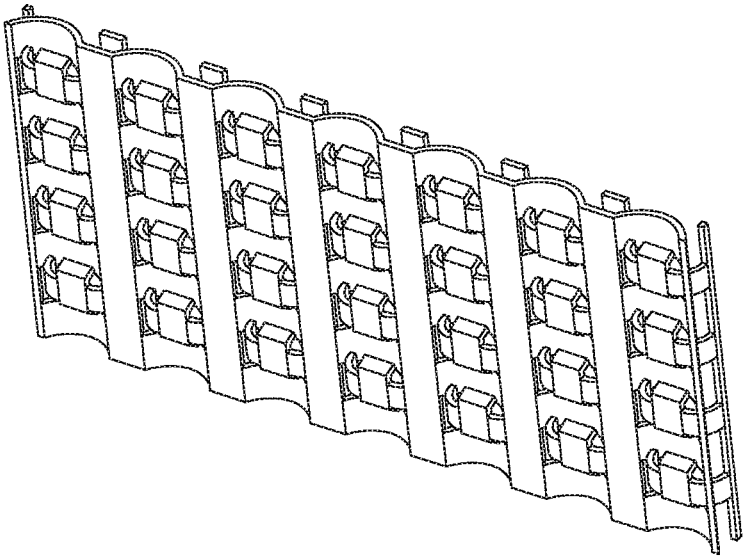
FIG. 7 is a perspective view corresponding to FIG. 6.

As the hinged assembly of the supplementary trusses to the main truss takes place as part of the pre-fabrication process in the factory, the supplementary trusses will be accurately positioned relative to the main truss. All that is required is for the supplementary truss to be swung about the vertical hinge axis into its required orientation transverse to the main truss and fastened at its outer end to underlying wall structure, usually the top plate of the underlying wall frame. The example which has been given is of a hip formed with three supplementary trusses hinged to the main truss. It will readily be understood that there may be more than or less than three supplementary trusses in such a structure and the general principles described herein are applicable to a wide range of other roof structures such as gables or valleys defined by trusses in mutually transverse orientations. FIG. 3 shows schematically a hip structure formed by a main truss 2 and four supplementary trusses 4.

Although as just described the hinged assembly of the supplementary trusses to the main truss is undertaken as part of the pre-fabrication in a factory situation, nevertheless many of the advantages provided by the present disclosure can be achieved with hinges pre-installed to the main truss during fabrication with the connection to the supplementary trusses being completed on-site prior to lifting into position with the supplementary trusses being folded against the face of the main truss during lifting. This enables the main truss and supplementary trusses to be transported to sites separately and may be necessary in circumstances where the length of the supplementary trusses causes difficulties in transportation when in their folded position against the main truss.

As briefly discussed at the outset, following erection into position roof trusses are usually fixed to the underlying top plate or other structure by brackets nailed to the top plate and lower chord of the truss, typically using a nail gun for this purpose. The present disclosure in its second aspect relates to a quick-connect two-part fastening pre-installed to the truss and top plate during the pre-fabrication of the truss and wall frame and which does not require working with a nail gun at height to make the connection. A preferred embodiment of the two-part fastening will now be described in detail. While the fastening is being described within the context of fastening a truss to a wall plate, the fastening has applicability in other situations where a strong, permanent, mechanical connection is required between components. For example it could be used to provide a connection between a main truss and further supplementary trusses (so-called jack trusses, for example) in the type of structure previously discussed, after erection and stabilisation of the main truss by the hinged supplementary trusses.

With reference to FIGS. 4 to 7 the quick-connect fastening of the preferred embodiment comprises male and female parts 10, 12 each of plate-like form, and each preferably being pressed out of metal sheet. The female part 12 is shaped to form a series of parallel crests 14 of arcuate form extending across the width of the plate, with valleys 16 in the form of flat lands between adjacent crests. Each crest is apertured along its length with a row of parallel slots 18 which are clearly shown in FIG. 5. The male part 10 is profiled in a manner generally corresponding to that of the female part except that each of the crests is defined by a row of generally parallel ribs 20 each of a width and peripheral configuration which enables the rib 20 to fit within one of the slots 18 when the face of one of the two parts is applied against the face of the other part. Flat lands 21 are formed between each row of ribs 20. The spacing between adjacent ribs 20 in each row of ribs corresponds to that between adjacent slots 18 in each row of slots, and the rows of ribs and slots are at the same spacing. A locking lug or tang 22 projects outwardly from the opposite edges of each rib 20, with the two tangs of each rib being in a divergent configuration. The configuration is such that when a rib 20 is pressed into a corresponding slot 18 in the female part, its two tangs 22 will deflect resiliently inwardly to enable the rib to enter the slot and when the two tangs have passed through the slot the two tangs will move outwardly under their inherent resilience to their original divergent configuration to engage behind the outer surface of the female plate in the zone of the slots in order to provide a positive locking engagement (see FIG. 6).

Although in the embodiment described, a locking tang extends from each of two opposite sides of each rib and which is the preferred arrangement, in principle locking could be achieved by just a single tang on each rib. In a further alternative, resiliently deflectable locking tangs could be formed on one or both sides of each slot with the tangs then being deflected by passage of the ribs through the slots on engagement of the two parts and then returning to their original configuration to positively lock the ribs within the slots against withdrawal.

In the example given of an attachment of the bottom chord of a truss to the top plate of a wall frame, one of the two parts, the female part for example, is fixed to the top plate with its slotted crests facing upwardly and the other part, in this case therefore the male part, is fixed to the underside of the bottom chord of the truss with its locking ribs facing downwardly. Fixing can occur by any suitable means such as screwing, nailing or gluing, or by nail-plates. Nailing or other fixing can occur through holes (the holes are not shown) formed in the flat lands 16, 21 of both plates and which will be in direct contact with the top plate and bottom chord. It will be understood that if the truss with its male plate 10 is pushed down onto the female plate 12 on the top plate to engage the locking ribs 20 within the slots 18, a positive locked connection between the two can be achieved very quickly. The connection is very strong and is not capable of release by application of reversed forces. In a typical situation where the wall frames and trusses and other components are prefabricated in a factory situation, the two parts of each fastening are installed during pre-fabrication to facilitate easy and accurate location of the truss relative to the wall frame during erection with coupling of the truss to the top plate being achieved very quickly by engagement of its coupling part with the corresponding coupling part already fixed to the top plate.

It will be understood that in this situation if the truss is perfectly aligned with the top plate, all of the locking ribs in the male part will engage and lock with the corresponding slots in the female part. Although in principle perfect alignment could arise (or could be achieved by manoeuvring the truss during installation) given that both parts of the fastening are installed in a factory situation which would permit high accuracy in placement, in practice this may not be possible in the erected structure for a variety of reasons, for example some inaccuracy in the laying of a concrete slab or other footings, inaccuracy in setting of the wall frames and so forth. The design of the two-part fastening provides a multiplicity of fixing points in a fixing matrix formed by parallel rows of locking ribs and slots. The sizing of the two parts in conjunction with the number of fixing points formed within the matrix can be determined so that even with a maximum expected degree of longitudinal and/or lateral misalignment between the two fastening parts likely to arise when the truss is lowered onto the top plate, a sufficient number of locking ribs will engage within the slots to provide the required secure connection between the truss and top plate. In typical Australian building conditions, the misalignment is likely to be no more than 20 mm whereby the two plates of the fastening can be designed to account for the eventuality.

Figure 8:
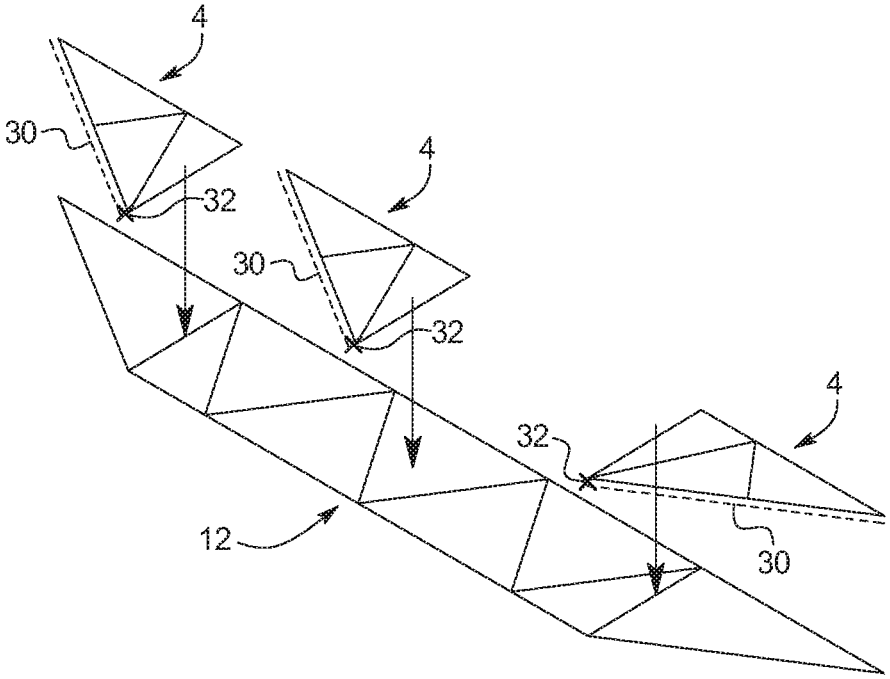
FIG. 8 is a view corresponding to FIG. 1 but showing a modification in which rafter extensions are hinged to the supplementary trusses.
Figure 9:
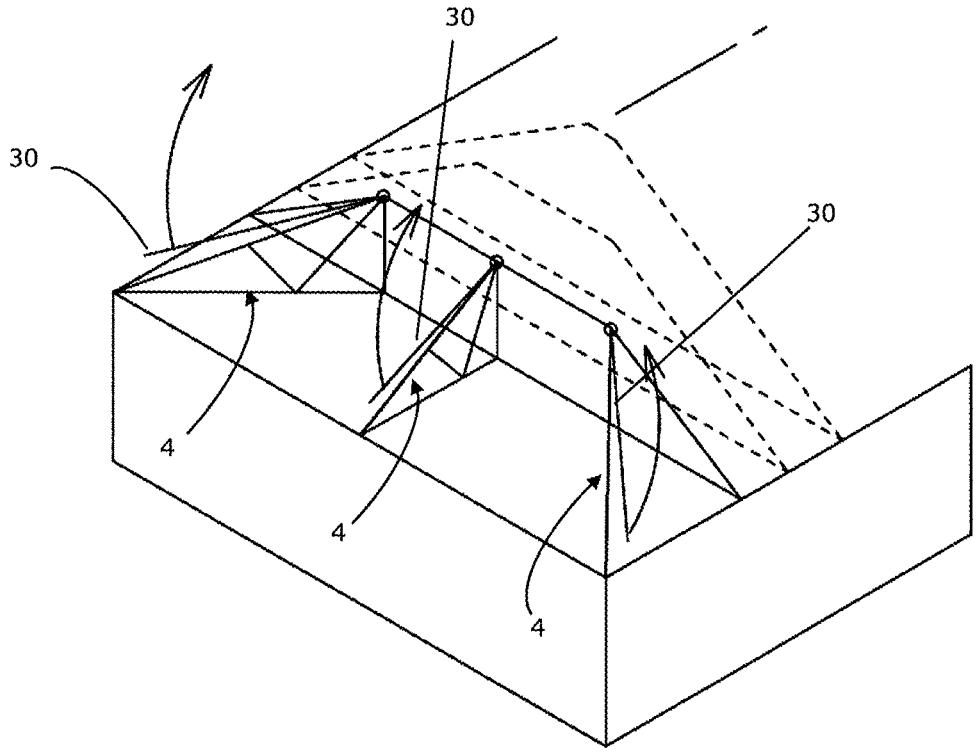
FIGS. 9 and 9A show highly schematically successive stages in folding out the rafter extensions to brace an adjacent main truss during installation thereof.
Figure 9A:
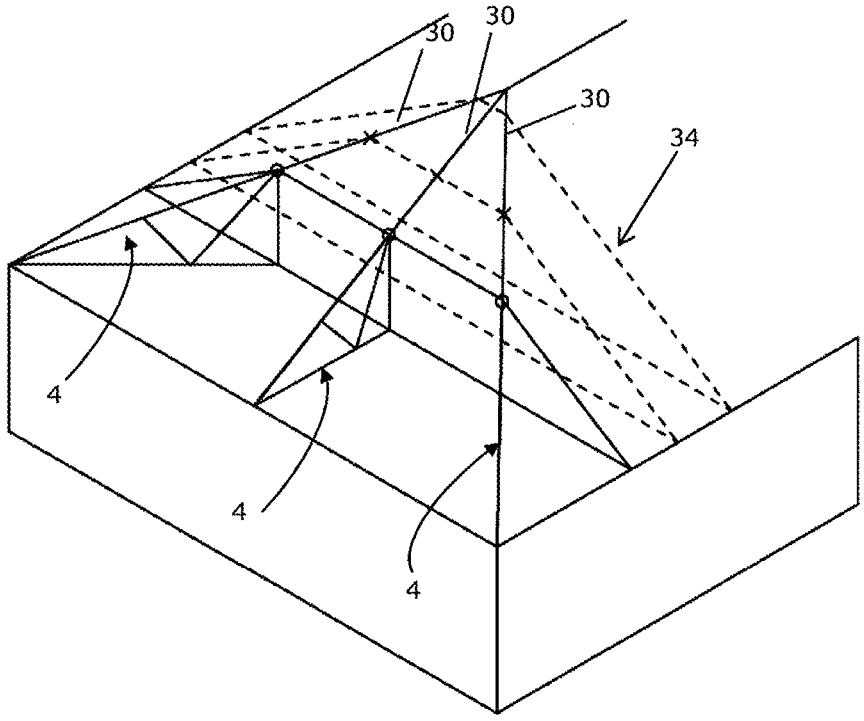

In a further development to facilitate installation of the roof structure, rafter extensions can be hinged to the top chords of the supplementary trusses at the inner ends thereof. During transportation and erection of the truss assembly as previously described, the extensions lie along the top chords of the supplementary trusses. After erection of the main truss and stabilisation by folding out of the supplementary trusses, the rafter extensions are hinged out to extend beyond the main truss into the zone occupied (or to be occupied) by an adjacent main truss of the structure whereby the rafter extensions when fitted to the top chord of the adjacent truss will serve to stabilise that truss during its installation. The extensions remain in position to form part of the overall roof structure and may serve to carry tile battens in the structure. This concept is shown schematically in FIGS. 8, 9 and 9A. In FIG. 8 which shows the truss assembly in exploded form, the rafter extensions are shown in the dashed lines 30, with the hinge connection to the top chord of the associated supplementary trusses being shown at 32. FIG. 9A shows the extensions 30 having been folded out to their extended configuration after erection of the truss assembly, and being connected to the top chord of the next adjacent main truss 34; FIG. 9 shows the extensions 30 at the commencement of folding them out.

Figure 10:
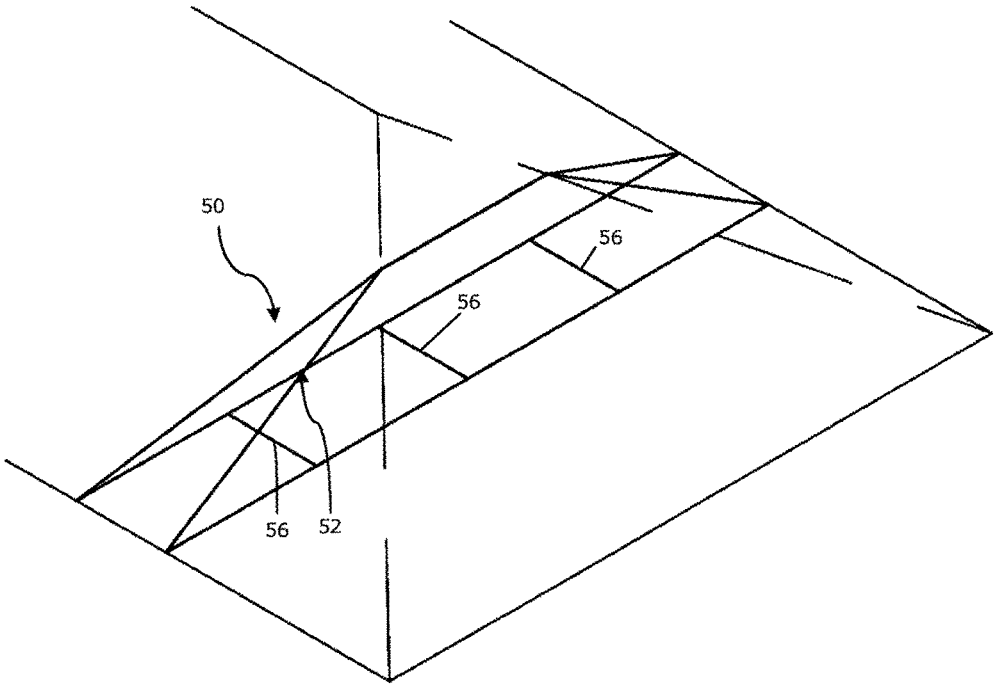
FIG. 10 shows highly schematically a braced truss assembly for use in forming a hip end of a roof.
Figure 11:
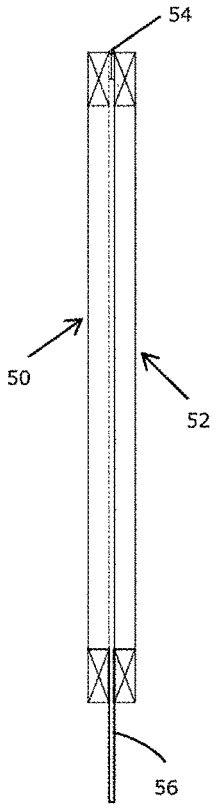
FIG. 11 shows in more detail the truss assembly of FIG. 10 but in a folded configuration for transportation and craning.
Figure 11A:
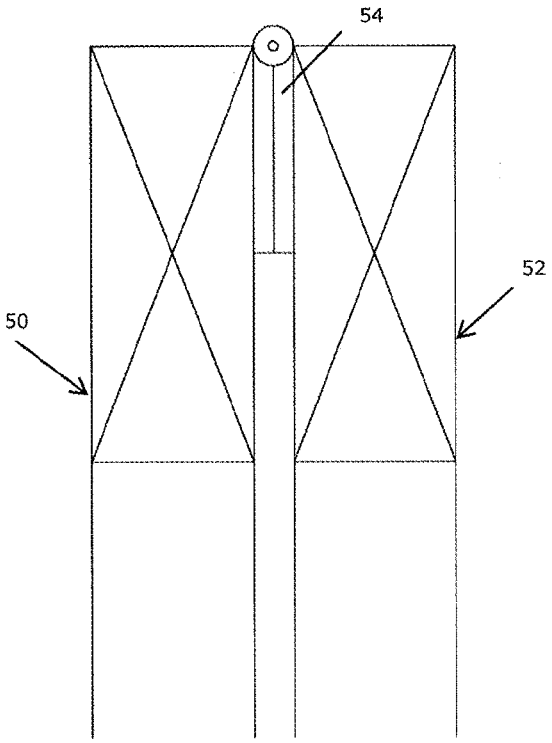
FIG. 11A shows a detail of FIG. 11.
Figure 12:
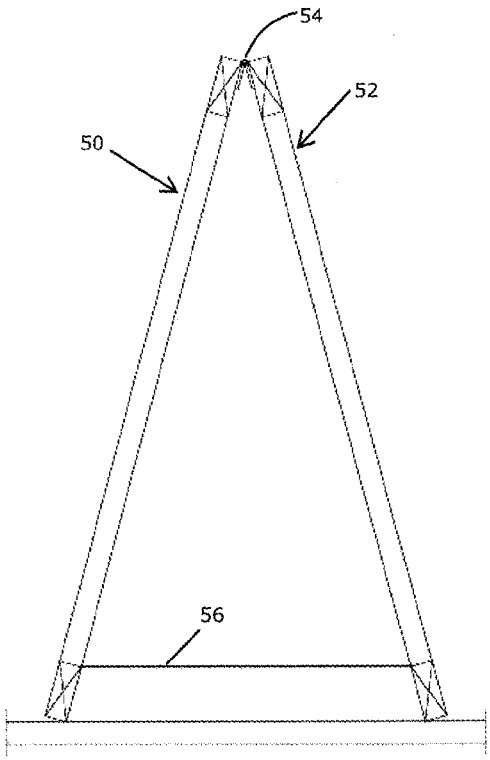
FIG. 12 is a view similar to FIG. 11 but showing the assembly in its erected configuration.

FIGS. 10 to 12 show schematically components for forming a braced structure of part of a roof hip end and to which further trusses or other structure can be subsequently attached without the need for any additional temporary bracing. The structure comprises two truncated trusses 50, 52 hinged together at their top chord preferably by two or more hinges 54 spaced along the top chord whereby the two trusses are pivotal about a horizontal axis adjacent the top chords between a folded configuration in which the trusses are in side-by-side relation (see FIGS. 11 and 11A) for transportation to site and craning into position on site and an erected configuration in which the two trusses are spread apart at their bottom chords and are thereby mutually inclined (see FIGS. 10 and 12). The bottom chords of the two trusses are interconnected by two or more pre-installed links 56 spaced along the bottom chords of the two trusses and which, in the erected configuration form rigid struts to provide rigid bracing between the bottom chords of the two trusses whereby in the erected or deployed configuration the assembly of the two trusses is inherently stable and can be placed in that condition on the top plate of the underlying structure. The structure as shown has three such links 56 but it will be understood that the number of required links will be dependent on the overall length of the two trusses.

Although the links 56 have only been illustrated schematically in the drawings, their structure is such that they must permit the trusses to lie in their folded configuration for transportation and craning and then permit the trusses to be swung into their erected configuration in which they then form rigid struts between the two bottom chords. A form of link which can achieve that consists of two arms hinged together at one end and each hinged at an outer end to respective one of the two bottom chords whereby in a folded configuration the two arms are lying in approximately parallel relation or are inclined by a small angle whereas in the erected configuration the two arms are substantially longitudinally aligned to constitute a bracing strut. Rigidity of the strut thus formed can be achieved in a number of different ways. One way of achieving this is to configure the hinged connection between the two arms in such a manner that as the trusses reach their fully erected configuration, the arms move slightly beyond a position in which they are longitudinally aligned into a locked over-centre position in which the arms provide a rigid lock against movement of the two bottom chords one towards the other. An alternative way of achieving the required rigidity is to provide a screw-operated lock or clamp between the inner ends of the two arms when the erected configuration is reached.

When the assembly consisting of the two rigidly braced deployed trusses is positioned on the top plate of the underlying structure and attached thereto and inherently stable as a consequence of its configuration, further trusses can be applied working from that stable assembly.

Figure 13:
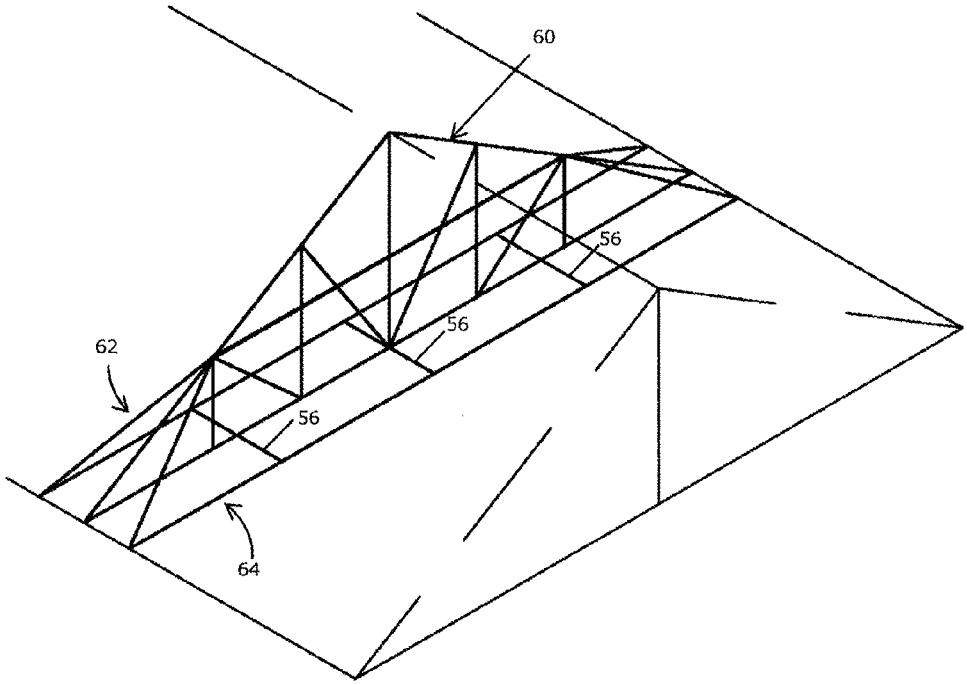
FIG. 13 is a highly schematic view of a truss assembly for use in forming a gable end of a roof.
Figure 14:
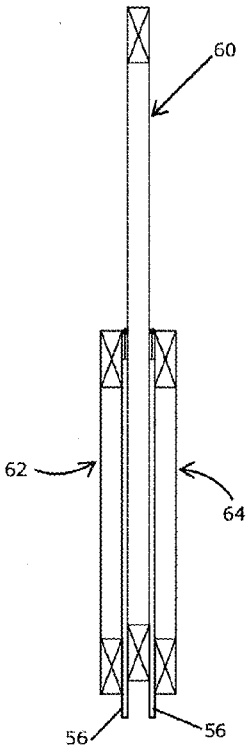
FIG. 14 shows in more detail the assembly of FIG. 13 but in a folded configuration for transportation and craning.
Figure 14A:
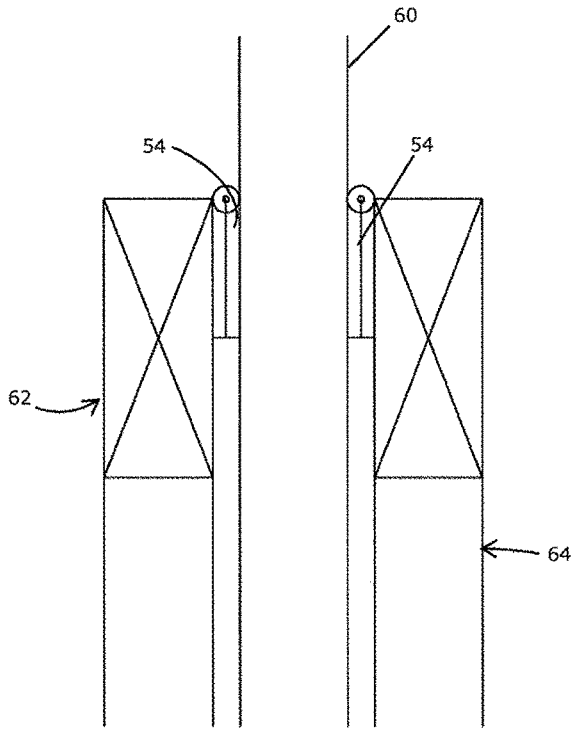
FIG. 14A shows a detail of FIG. 14.
Figure 15:
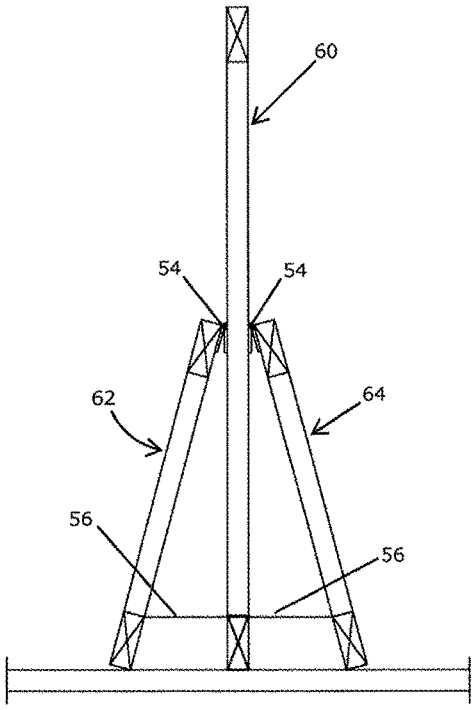
FIG. 15 is a view similar to FIG. 14 but showing the assembly in its erected configuration.

FIGS. 13 to 15 relate to a similar concept to that of FIGS. 10 to 12 but applied to structure for forming a gable end consisting of a central gable truss 60 and two truncated trusses 62, 64 on opposite sides of the central truss 60 and each connected by hinges 54 to an intermediate chord of the central truss for movement about a horizontal axis adjacent the intermediate chord between a folded configuration for transportation and craning into position in which the three trusses lay side-by-side (see FIGS. 14 and 14A) to an erected configuration in which the truncated trusses are pivoted outwardly into a stable condition inclined to the central truss (see FIGS. 13 and 15) and rigidly braced in that condition by struts extending between the bottom chord of each of the truncated trusses and the bottom chord of the central truss. The struts are formed by links 56 of the form described with reference to FIGS. 10 to 12.

The invention claimed is:

1. A truss assembly for use in building construction, the truss assembly comprising:

a first truss;

a second truss hingedly connected to the first truss so the second truss is pivotable about a second truss pivot axis from a second truss folded configuration in which the second truss lies adjacent a face of the first truss to an erected configuration in which the second truss extends transversely to the face of the first truss; and a rafter extension hingedly connected to the second truss so the rafter extension is pivotable about a rafter extension pivot axis from a rafter extension folded configuration in which the rafter extension lies adjacent a top chord of the second truss to an extended configuration, wherein the second truss pivot axis is transverse to the rafter extension pivot axis.

2. The truss assembly of claim 1, which includes two or more second trusses spaced lengthwise along the first truss.

3. The truss assembly of claim 2, wherein the first truss is a main truss and each of the two or more second trusses is a supplementary truss.

4. The truss assembly of claim 1, wherein when the rafter extension is in the extended configuration, the rafter extension forms bracing for an adjacent main truss during its subsequent installation.

5. The truss assembly of claim 1, wherein the second truss extends substantially perpendicular to the face of the first truss when in the erected configuration.

6. The truss assembly of claim 1, wherein the rafter extension extends away from, and is generally parallel to, the top chord of the second truss when in the extended configuration.

7. The truss assembly of claim 1, wherein the rafter extension and the second truss extend away from the first truss in opposite directions when the rafter extension is in the extended configuration and the second truss is in the erected configuration.

8. The truss assembly of claim 1, wherein the rafter extension pivot axis is substantially perpendicular to the second truss pivot axis.

9. The truss assembly of claim 1, wherein the second truss pivot axis is generally vertical.

* * * * *